US008198965B2

(12) United States Patent
Schrom et al.

(10) Patent No.: US 8,198,965 B2
(45) Date of Patent: Jun. 12, 2012

(54) GROUNDING OF MAGNETIC CORES

(75) Inventors: Gerhard Schrom, Hillsboro, OR (US); Donald Gardner, Mountain View, CA (US); Peter Hazucha, Beaverton, OR (US); Fabrice Paillet, Hillsboro, OR (US); Tanay Karnik, Portland, OR (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 12/939,945

(22) Filed: Nov. 4, 2010

(65) Prior Publication Data

US 2011/0043318 A1 Feb. 24, 2011

Related U.S. Application Data

(63) Continuation of application No. 12/431,882, filed on Apr. 29, 2009, now Pat. No. 7,843,304, which is a continuation of application No. 11/694,812, filed on Mar. 30, 2007, now Pat. No. 7,538,653.

(51) Int. Cl.
*H01F 27/02* (2006.01)

(52) U.S. Cl. ..... 336/83

(58) Field of Classification Search ..... 336/65, 336/83, 200, 232, 192; 333/185
See application file for complete search history.

(56) References Cited

U.S. PATENT DOCUMENTS

| | | | | |
|---|---|---|---|---|
| 4,543,553 | A * | 9/1985 | Mandai et al. | 336/83 |
| 6,121,852 | A * | 9/2000 | Mizoguchi et al. | 333/35 |
| 6,191,495 | B1 * | 2/2001 | Kossives et al. | 257/798 |
| 6,495,019 | B1 * | 12/2002 | Filas et al. | 205/119 |
| 6,856,226 | B2 * | 2/2005 | Gardner | 336/192 |
| 7,423,508 | B2 * | 9/2008 | Gardner et al. | 336/200 |
| 2005/0068676 | A1 * | 3/2005 | Lille et al. | 360/126 |
| 2010/0319802 | A1 * | 12/2010 | Hattori | 140/71 C |

* cited by examiner

*Primary Examiner* — Tuyen Nguyen
(74) *Attorney, Agent, or Firm* — Kacvinsky Daisak, PLLC

(57) ABSTRACT

An apparatus includes a magnetic core, a ground node, and one or more vias to provide a connection between the magnetic core and the ground potential. The magnetic core includes a first magnetic layer and a second magnetic layer. In addition, the apparatus may include a conductive pattern. The conductive pattern may be at a third layer between the first and second magnetic layers. The apparatus may be included in inductors, transformers, transmission lines, and other components using ferromagnetic cores or shields. Such components may be integrated on a chip or die.

15 Claims, 7 Drawing Sheets

200

300

400

400

GROUNDING OF MAGNETIC CORES

BACKGROUND

Electronic components, such as inductors, may be implemented on substrates such as an integrated circuit die or a printed circuit board (PCB). Such implementations involve placing patterns of material (e.g., as conductive material) on one or more substrate layers. This placement may be through lithographic techniques.

The connection of particular elements in such implementations to nodes, such as ground, is desirable in certain situations. Techniques to provide such connections are also desirable.

DETAILED DESCRIPTION

Various embodiments may be generally directed to techniques involving electronic components. For instance, in embodiments, an apparatus may include a magnetic core, a ground node, and one or more vias to provide a connection between the magnetic core and the ground potential. The magnetic core includes a first magnetic layer and a second magnetic layer. In addition, the apparatus may include a conductive pattern. The conductive pattern may be at a third layer between the first and second magnetic layers.

The apparatus may be included in inductors, transformers, transmission lines, and other components using ferromagnetic cores or shields. Such components may be integrated on a chip or die. Thus, embodiments may be employed in the context of on-die magnetics. Magnetic cores may include one or more layers of ferromagnetic material. Magnetic shield may be formed by a thin layer of ferromagnetic material.

The invention is to make an electrical connection between the core and an AC ground (e.g., ground, a supply voltage, any node with low impedance and little or no voltage noise).

Embodiments may advantageously reduce the electrostatic noise on magnetic cores. This may improve isolation the of radio frequency (RF) front-end circuitry from noise originated by digital circuits or components (in fact, some RF applications cannot yet be integrated on a digital CMOS process because of substrate noise being picked up by large on-die air-core inductors). Further, embodiments may increase wire-to-ground capacitance. This may improve efficiency, for example, in soft switching modes. Also, embodiments may reduce wire-to-wire capacitance. As a result, useful frequency ranges may be extended.

Embodiments may comprise one or more elements. An element may comprise any structure arranged to perform certain operations. Each element may be implemented with various technologies or processes, as desired for a given set of design parameters or performance constraints. Although an embodiment may be described with a limited number of elements in a certain topology by way of example, the embodiment may include other combinations of elements in alternate arrangements as desired for a given implementation. It is worthy to note that any reference to "one embodiment" or "an embodiment" means that a particular feature, structure, or characteristic described in connection with the embodiment is included in at least one embodiment. The appearances of the phrase "in one embodiment" in various places in the specification are not necessarily all referring to the same embodiment.

Figure 1:
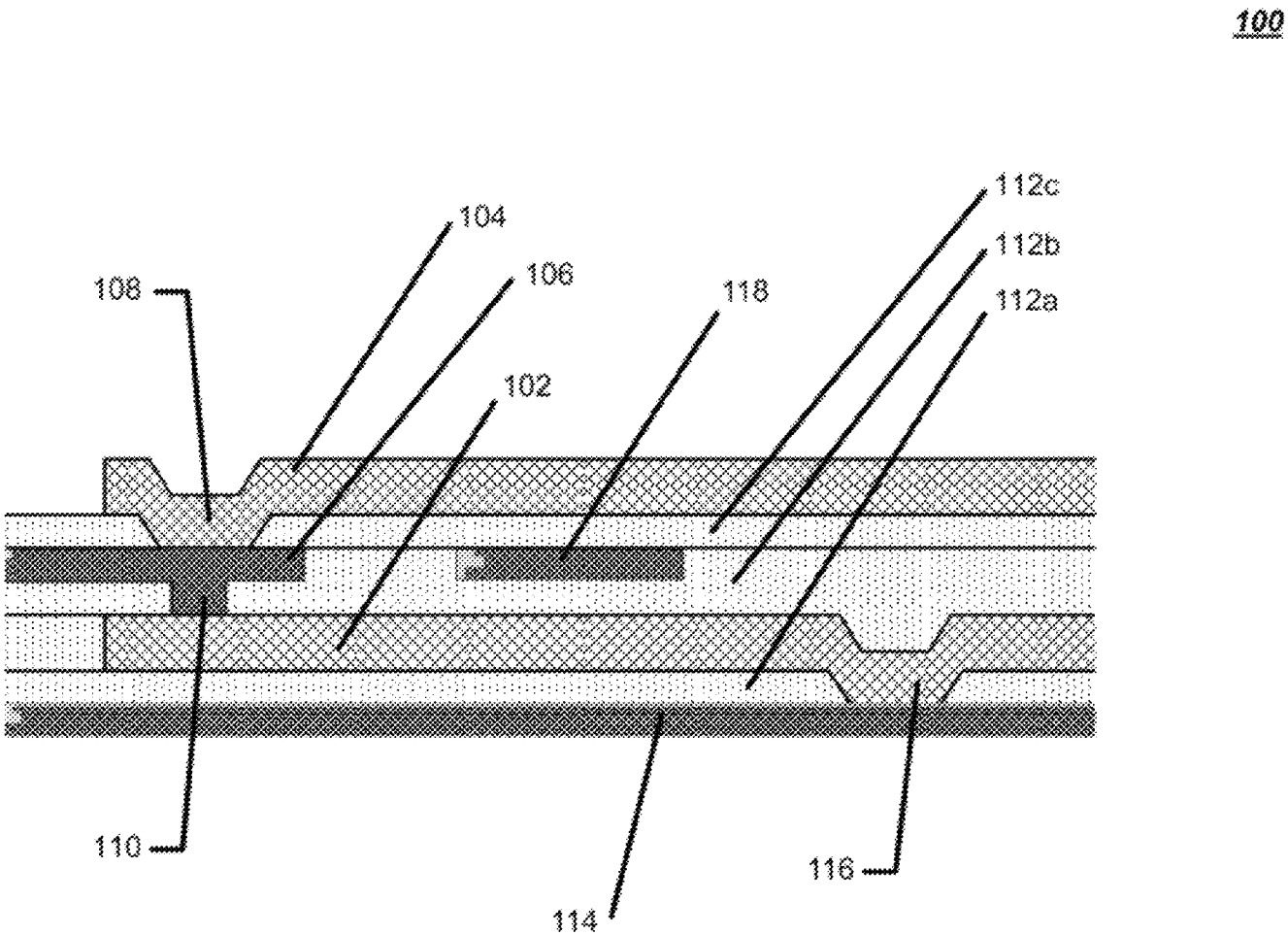
FIG. 1 is a view of an exemplary embodiment.

FIG. 1 is a side cross-section view of an apparatus 100, which may be included in various types of electronic components, devices, or circuits. As shown in FIG. 1, Apparatus 100 includes a first magnetic layer 102 (also referred to as the bottom magnetic layer), a second magnetic layer 104 (also referred to as the top magnetic layer), and a metal layer 106 between magnetic layers 102 and 104. In addition, apparatus 100 includes insulating layers 112*a*, 112*b*, and 112*c*. FIG. 1 shows insulating layer 112*a* being underneath magnetic layer 102, while insulating layers 112*b* and 112*c* are between magnetic layers 102 and 104. Moreover, FIG. 1 shows a metal layer 114 underneath insulating layer 112*a*.

Vias are employed to connect various layers. For instance, FIG. 1 shows a via 108 connecting magnetic layer 104 to metal layer 106. In turn, a via 110 connects metal layer 106 to magnetic layer 110. Further, a via 116 provides a connection between magnetic layer 102 and metal layer 114. In embodiments, vias 108, 110, and 116 may each comprise magnetic (ferromagnetic) or conductive materials. Such magnetic materials may comprise components such as titanium for adhesion.

Magnetic elements of apparatus 100 may, together, provide a magnetic core. For example, this magnetic core may comprise magnetic layers 102 and 104. Further, in embodiments, magnetic core may also comprise via 108, via 116, and or via 110. However, the embodiments are not limited to these examples.

As described above, apparatus 100 may be included in various electronic components, devices, or circuits. For instance, FIG. 1 shows that apparatus 100 may include a conductive element 118. Conductive element 118 may be included in an inductor winding, a transformer winding, a balun, a transmission line, and so forth. Thus, the embodiments are not limited to these examples.

FIG. 1 shows metal layer 114 (through vias 108 and 110) being connected to magnetic layers 102 and 104. Similarly, through via 116 (and vias 108 and 110), magnetic layers 102 and 104 are connected to metal layer 114. Thus, metal layer 106 and/or metal layer 114 may provide grounding for a magnetic core of apparatus 100.

Thus, magnetic cores may be grounded between their layers (e.g., at metal layer 106). Additionally or alternatively, magnetic cores may be grounded underneath their layers (e.g., at metal layer 114). As a further addition or alternative, magnetic cores may be grounded above their layers (e.g., above magnetic layer 104). Such underneath and above groundings may be employed in multiple layer magnetic cores or in single layer magnetic cores. Moreover, grounding of magnetic cores may occur sideways.

In embodiments, a connection between a metal layer and a magnetic layer are established by creating an opening in one or more insulating layers (e.g., layers 112*a*, 112*b*, and/or 112*c*) that are between the metal and the magnetic layers. Ones created, the openings may be filled with either metal or with magnetic material. Such fillings may be referred to as vias.

Connections of magnetic cores to grounded metal may be selected such that the metal is away from high magnetic fields. This may advantageously avoid additional eddy currents. For example, in a two-layer magnetic core, such connection(s) to the core may be made outside the magnetic via. An example of such a connection is shown below in FIGS. 2A and 2B. In a one layer core, such connection(s) may be made at a distance from the circuit conductors (e.g., conductive element 118). As described above, such circuit conductors may be inductor windings. The embodiments, however, are not limited to such.

In general operation, apparatus 100 provides grounding for AC voltage(s) on magnetic elements. With reference to FIG. 1, exemplary magnetic elements include magnetic layers 104 and 106, as well as vias 108 and 116. Such magnetic elements may be collectively referred to as a core. Thus, embodiments may provide grounding for a core. As a result, conductive elements, such as conductive element 118 may advantageously be shielded from surrounding circuitry. Thus, the propagation of noise may be reduced (or even eliminated).

Moreover, embodiments may provide termination for most of the electric field lines emanating from conductive elements, such as conductive element 118. Thus, parasitic capacitance between such conductive elements (e.g., inductor wires) may be reduced. For inductor embodiments, the may cause an increase in series resonance frequency, allowing the inductors to be used at higher frequencies.

Figure 2A:
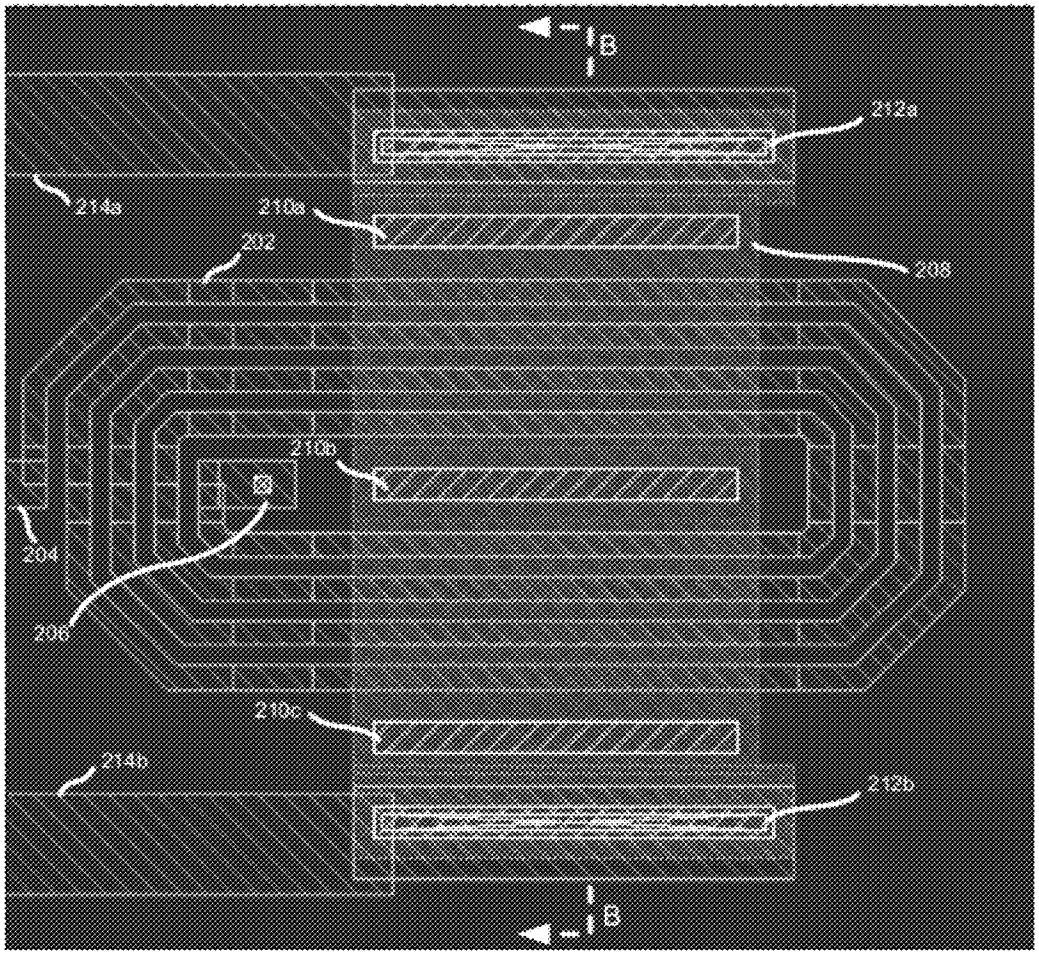
FIGS. 2A and 2B are views of an inductor embodiment.

FIG. 2A is a top layout view of an inductor embodiment 200. More particularly, inductor 200 is a spiral inductor with a grounded magnetic core. As shown in FIG. 2A, inductor 200 includes a winding 202 of conductive material having terminals 204 and 206. A top magnetic layer 208 covers a portion of winding 202. Moreover, magnetic vias 210*a*, 210*b*, and 210*c* connect top magnetic layer 208 to a bottom magnetic layer (shown in FIG. 2B as a layer 207).

Together, top magnetic layer 208, vias 210*a-c*, and the bottom magnetic layer form a magnetic core for inductor 200. As described above, this magnetic core is grounded.

As shown in FIG. 2A, ground couplings 212*a* and 212*b* provide ground connections for the magnetic core. More particularly, ground couplings 212*a* and 212*b* connect the magnetic core to ground wires 214*a* and 214*b*, respectively.

Figure 2B:
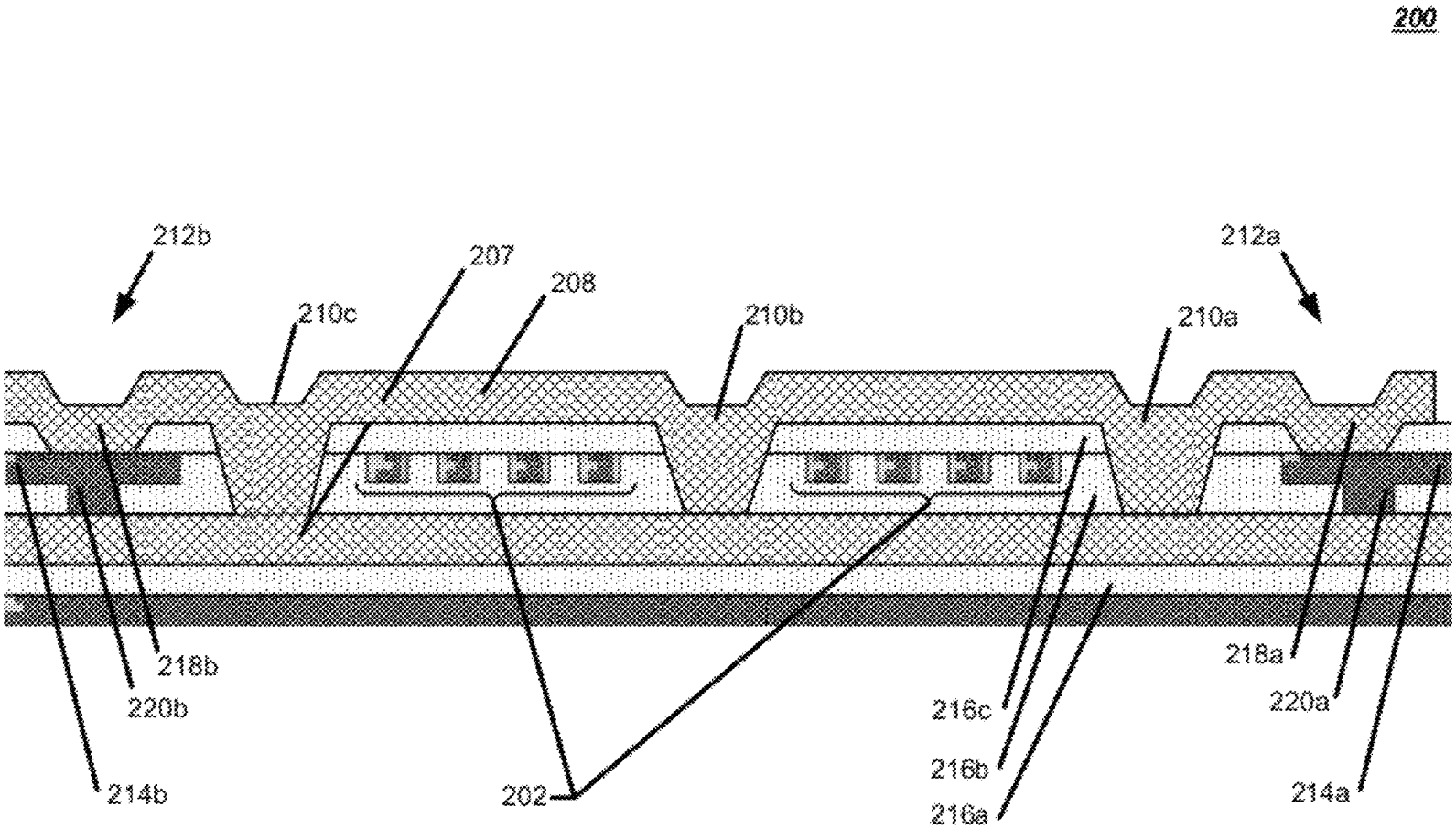

FIG. 2B is a cross-sectional side view of inductor 200. This view shows a first insulating layer 216*a*, a second insulating layer 216*b*, and a third insulating layer 216*c*. In addition, this view shows top magnetic layer 208 being above third insulating layer 216*c*. Further, FIG. 2B shows bottom magnetic layer 207 being between first insulating layer 216*a* and second insulating layer 216*b*.

Magnetic vias 210*a*, 210*b*, and 210*c* connect magnetic layers 207 and 208 at areas alongside winding 202. Collectively, magnetic layer 207, magnetic layer 208, and magnetic vias 210*a*-210*c* may be referred to as a magnetic core.

As shown in FIG. 2B, ground wires 214*a* and 214*b* (which are connected to the magnetic core) on the same layer as windings 202, which is between magnetic layers 207 and 208.

FIG. 2B shows that ground coupling 212*a* comprises an opening (via) 218*a* in third insulating layer 216*c*, and an opening (via) 220*a* in second insulating layer 216*b*. Opening 218*a* (which may be composed of a magnetic material) connects magnetic layer 208 to ground wire 214*a*, while opening 220*a* (which may be composed of a conductive material) connects magnetic layer 207 to ground wire 214*a*.

Similarly, FIG. 2B shows that ground coupling 212*b* comprises an opening (via) 218*b* in third insulating layer 216*c*, and an opening (via) 220*b* in second insulating layer 216*b*. Opening 218*b* (which may be composed of a magnetic material) connects magnetic layer 208 to ground wire 214*b*, while opening 220*b* (which may be composed of a conductive material) connects magnetic layer 207 to ground wire 214*b*.

Figure 3A:
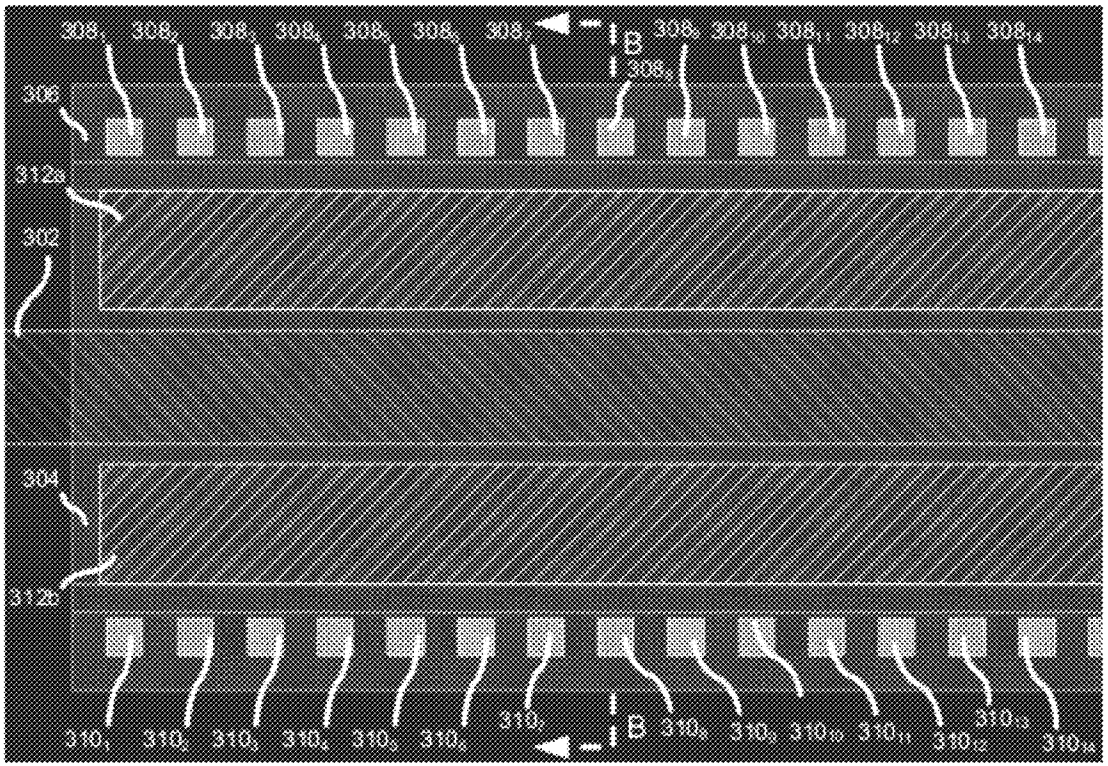
FIGS. 3A and 3B are views of a transmission line embodiment.

Embodiments are not limited to inductors. For example, FIG. 3A is a top layout view of a transmission line embodiment 300. As shown in FIG. 3A, transmission line 300 includes a line 302 of conductive material. A top magnetic layer 304 covers line 302. Moreover, magnetic vias 312*a* and 312*b* connect top magnetic layer 304 to a bottom magnetic layer 306.

Further, FIG. 3A shows multiple openings (vias) 308 and 310. These openings provide an electrical connection between bottom magnetic layer 306 and grounded metal underneath (shown in FIG. 3B as a layer 316).

Figure 3B:
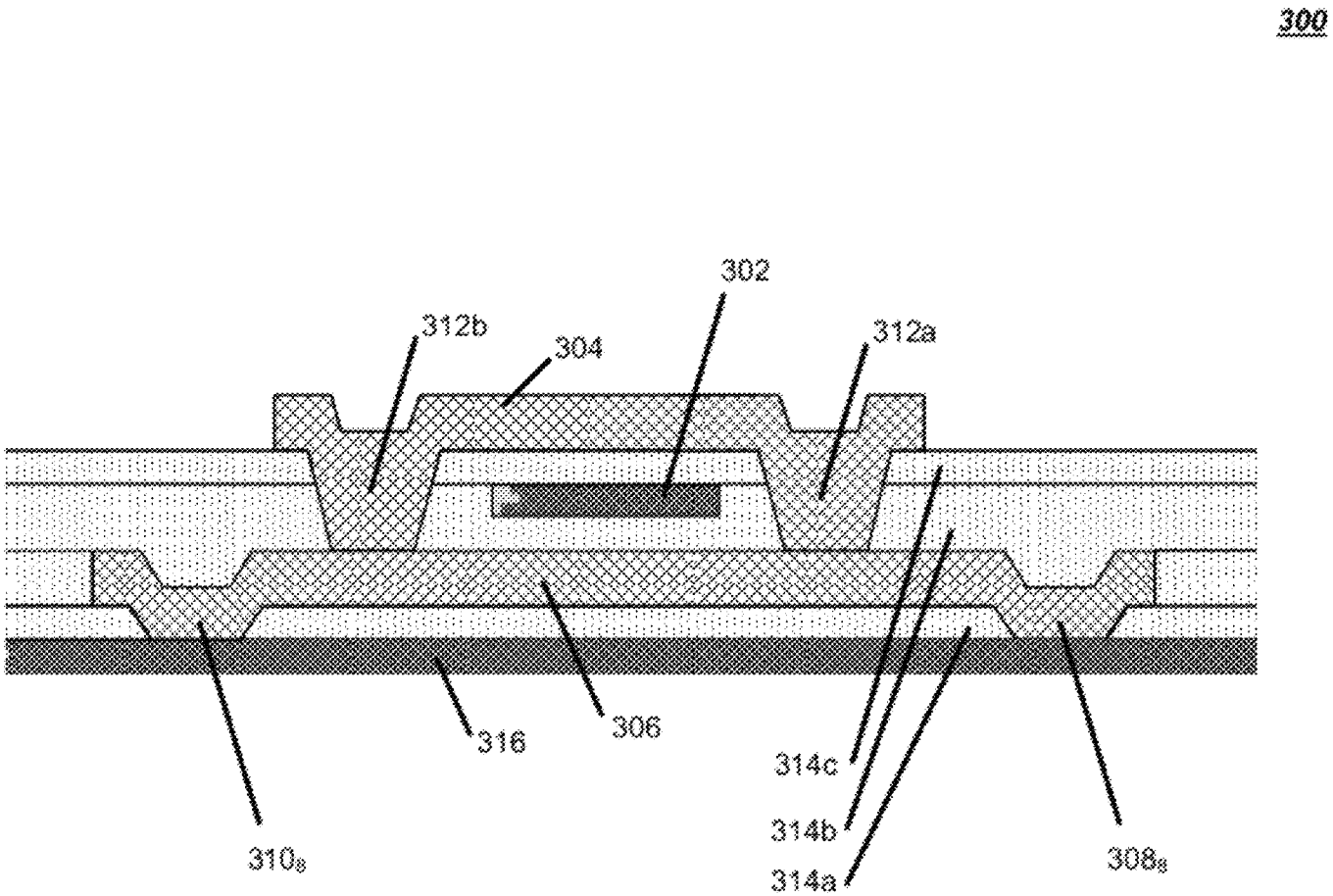

FIG. 3B is a cross-sectional side view of transmission line 300. This view shows a first insulating layer 314*a*, a second insulating layer 314*b*, and a third insulating layer 314*c*. In addition, this view shows top magnetic layer 304 being above third insulating layer 314*c*. Further, FIG. 3B shows bottom magnetic layer 306 being between first insulating layer 314*a* and second insulating layer 314*b*.

As shown in FIG. 3B, openings (vias) $\mathbf{308}_8$ and $\mathbf{310}_8$ connect bottom magnetic layer 306 to grounded metal layer 316, which is under first insulating layer 314*a*. Vias 308 and 310 may comprise magnetic (ferromagnetic) or conductive materials. Such magnetic materials may comprise components such as titanium for adhesion.

Figure 4A:
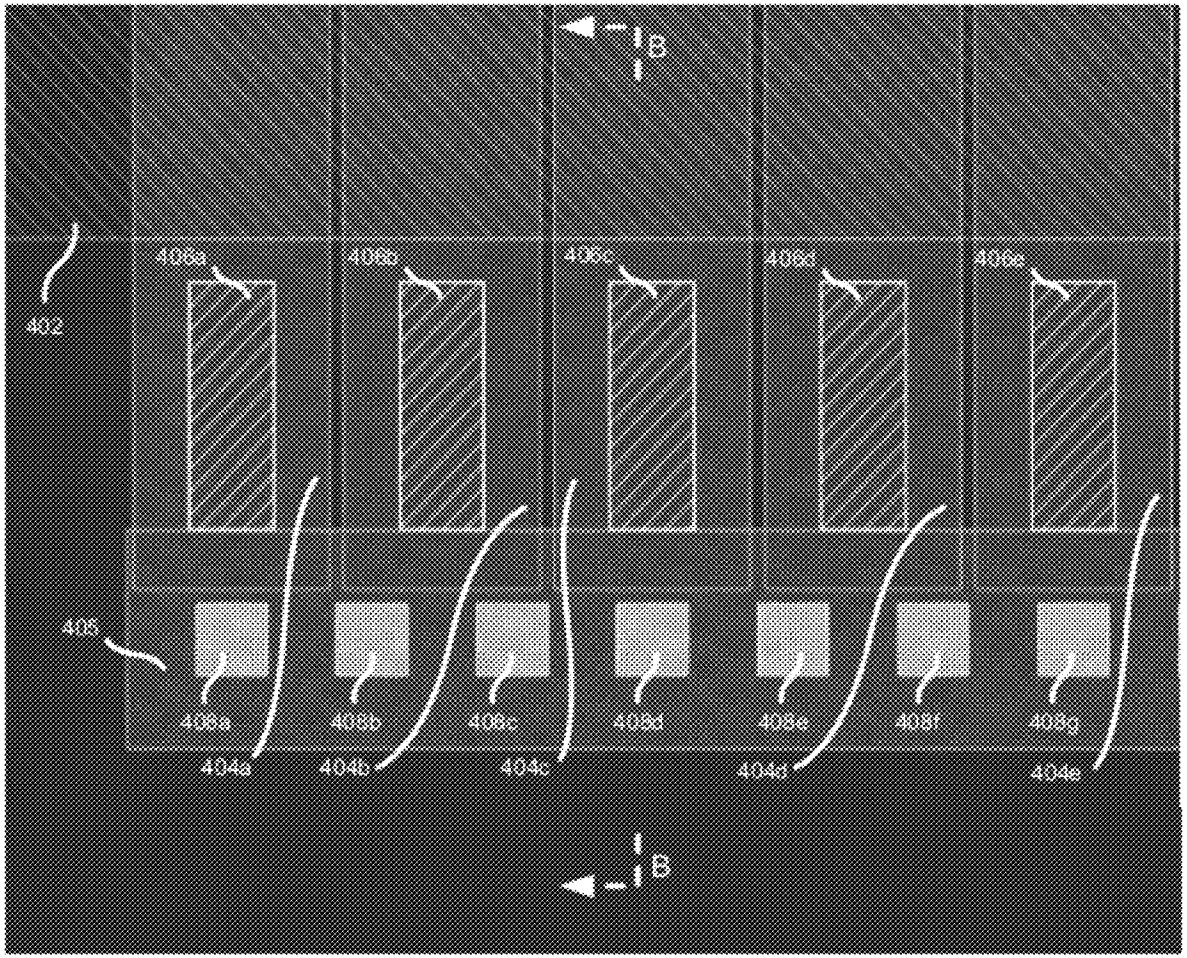
FIGS. 4A and 4B are views of a further transmission line environment.
Figure 4B:
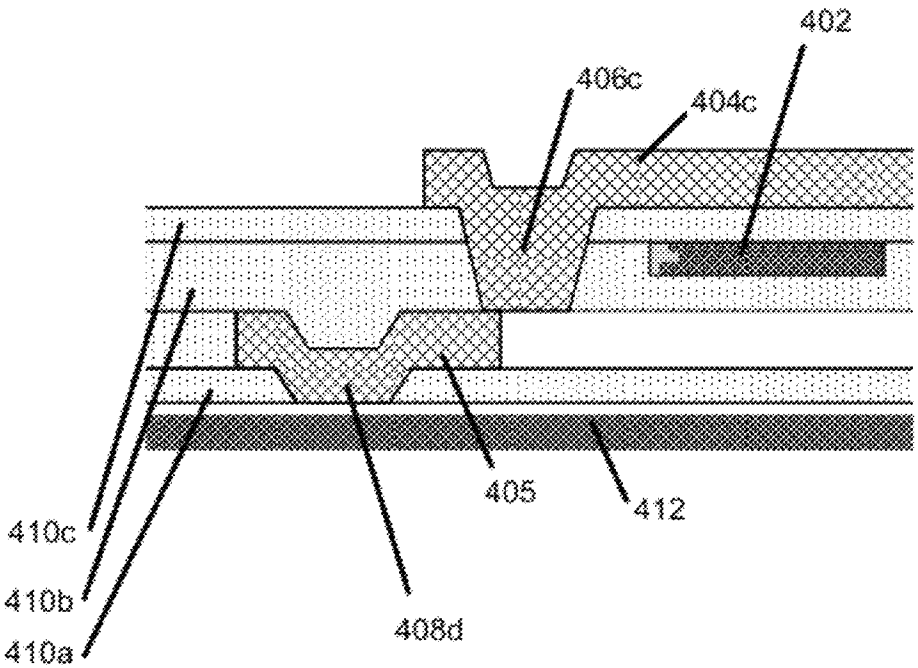

A further transmission line example is shown in FIGS. 4A and 4B. More particularly, these drawings show a transmission line embodiment 400 having a slotted magnetic core.

FIG. 4A is a top layout view of transmission line embodiment 400. In particular, FIG. 4A shows a portion of transmission line 400 that is on one side of a conductive line 402. However, the other side, which is not depicted, may be implemented in the same or similar manner.

As shown in FIG. 4A, a slotted top magnetic layer covers line 402. This slotted layer comprises multiple magnetic members 404. Moreover, magnetic vias 406 connect corresponding magnetic members 404 to a bottom magnetic layer having a strip 405. Further, this bottom magnetic layer may have slotted portions in a same or similar manner as the top magnetic layer.

In addition, FIG. 4A shows multiple openings (vias) 408. These openings provide an electrical connection between the bottom magnetic layer and grounded metal layer underneath (shown in FIG. 4B as a layer 412).

FIG. 4B is a cross-sectional side view of transmission line 400. This view shows a first insulating layer 410*a*, a second insulating layer 410*b*, and a third insulating layer 410*c*. In addition, this view shows member 404*c* of the top magnetic layer being above third insulating layer 410*c*. Further, FIG. 4B shows strip 405 being between first insulating layer 410*a* and second insulating layer 410*b*.

As shown in FIG. 4B, opening (via) 406*c* connects member 404*c* to strip 405. In turn, an opening (via) 408*d* connects strip 405 to grounded metal layer 412, which is under first insulating layer 410*a*. Thus, grounding is implemented in a sideways manner. Vias 406 and 408 may comprise magnetic (ferromagnetic) or conductive materials. Such magnetic materials may comprise components such as titanium for adhesion.

Various embodiments have been disclosed above. However, they are made for purposes of illustration, and not for limitation. Various embodiments provide grounding connections for magnetic cores. Such embodiments may involve connections between various layers.

For instance, embodiments may provide an opening in insulating layer(s) on top of a metal and deposit a magnetic-layer stack in the opening such that the metal is electrically connected to the magnetic material. The metal may be connected to a circuit node, such as, for example, a ground or a supply voltage.

Further embodiments provide an opening in the insulating layer(s) on top of magnetic material and deposit a metal-layer stack in the opening such that the metal is electrically connected to the magnetic material.

Yet further embodiments may employ a combination of the above, in which one metal layer is connected to a magnetic layer below and to another magnetic layer above. Similarly, a magnetic layer stack may be connected to a metal layer below and to another metal layer above. The locations of such connections (vias) do not have to coincide in layout. However, they may.

Moreover, combinations of such embodiments may be employed. Also, embodiments may employ sideways connections to connect to other areas. In addition, multiple devices (e.g., inductors, baluns, transformers, transmission lines, and so forth) may share node (e.g., ground) connections.

Numerous specific details have been set forth herein to provide a thorough understanding of the embodiments. It will be understood by those skilled in the art, however, that the embodiments may be practiced without these specific details. In other instances, well-known operations, components and circuits have not been described in detail so as not to obscure the embodiments. It can be appreciated that the specific structural and functional details disclosed herein may be representative and do not necessarily limit the scope of the embodiments.

Some embodiments may be described using the expression "coupled" and "connected" along with their derivatives. These terms are not intended as synonyms for each other. For example, some embodiments may be described using the terms "connected" and/or "coupled" to indicate that two or more elements are in direct physical or electrical contact with each other. The term "coupled," however, may also mean that two or more elements are not in direct contact with each other, but yet still co-operate or interact with each other.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

The invention claimed is:

1. An apparatus, comprising:

a magnetic core, comprising:

a first magnetic layer and a second magnetic layer, the first magnetic layer comprising a first slotted magnetic layer having a first plurality of magnetic members extending in the direction of the second magnetic layer and the second magnetic layer comprising a second slotted magnetic layer having a second plurality of magnetic members extending in the direction of the first magnetic layer;

a conductive pattern between the first magnetic layer and the second magnetic layer; and one or more vias to provide a connection between the first magnetic layer and the second magnetic layer; and one or more ground wires which are connected to the magnetic core to ground the magnetic core.

2. The apparatus of claim 1, wherein the second magnetic layer is above one or more insulating layers.

3. The apparatus of claim 1, wherein the first magnetic layer is between a first and a second insulating layer.

4. The apparatus of claim 1, wherein a conductive pattern is a winding.

5. The apparatus of claim 4, wherein the first magnetic layer covers a portion of the winding.

6. The apparatus of claim 4, wherein the one or more vias connect the first and second magnetic layers at areas alongside the winding.

7. The apparatus of claim 1, wherein the vias comprise magnetic materials.

8. The apparatus of claim 1, wherein the magnetic core is part of an inductor.

9. The apparatus of claim 1, wherein corresponding magnetic members from the first and second plurality of magnetic members are connected by a plurality of vias.

10. The apparatus of claim 1, wherein the magnetic core further comprises a first magnetic via at a first side of the conductive pattern and a second magnetic via at a second side of the conductive pattern, wherein the first side is opposite to the second side.

11. The apparatus of claim 1, wherein the one or more vias comprise titanium.

12. The apparatus of claim 1, wherein the one or more ground wires are on a same layer as the conductive pattern.

13. The apparatus of claim 1, further comprising:

one or more ground couplings to connect the magnetic core to the one or more ground wires.

14. The apparatus of claim 1, wherein the magnetic core is part of a transmission line.

15. The apparatus of claim 1, further comprising:

a grounded metal layer under the first magnetic layer.

* * * * *